US006106074A

United States Patent [19]

Chang

[11] Patent Number: 6,106,074

[45] Date of Patent: Aug. 22, 2000

[54] ILLUMINATING ROLLER FOR IN-LINE SKATES

[76] Inventor: Su-Jen Chang, P.O. Box 82-144, Taipei, Taiwan

[21] Appl. No.: 09/172,630

[22] Filed: Oct. 14, 1998

[51] Int. Cl.[7] ..... A63C 17/22

[52] U.S. Cl. ..... 301/5.3; 280/11.22; 280/816; 301/64.7; 362/78

[58] Field of Search ..... 280/11.22, 11.19, 280/11.23, 11.27, 87.042, 807, 809, 811, 816; 301/5.3, 5.7, 64.7; 310/67 A; 152/323; 362/78; 429/98, 97, 99

[56] References Cited

U.S. PATENT DOCUMENTS

| | | | |
|---|---|---|---|
| 4,430,009 | 2/1984 | Muller | 368/203 |
| 5,149,604 | 9/1992 | Nakanishi | 429/97 |
| 5,308,152 | 5/1994 | Ho | 301/5.3 |
| 5,536,074 | 7/1996 | Hsu et al. | 301/5.3 |
| 5,552,972 | 9/1996 | Rezvani | 362/78 |
| 5,649,716 | 7/1997 | Zhang | 280/11.19 |
| 5,718,499 | 2/1998 | De Caro | 362/78 |
| 5,730,520 | 3/1998 | Hsu et al. | 362/78 |
| 5,779,344 | 7/1998 | Tseng | 362/78 |
| 5,810,450 | 9/1998 | Tsu et al. | 301/5.3 |

*Primary Examiner*—J. J. Swann
*Assistant Examiner*—J. Allen Shriver
*Attorney, Agent, or Firm*—A & J

[57] ABSTRACT

An illuminating roller for in-line skates includes an outer circular body having an axial opening and an inner side provided with a plurality of pins, an inner circular body fitted inside the outer circular body and having an axial hole aligned with the axial opening, two battery recesses, and a vibration switch hole, a circuit board fitted in a cavity of the second half, the circuit board being provided with an IC, two battery mountings made of metal and fitted in the two battery recesses, batteries fitted on the battery mountings for supplying power to the IC, a battery cover made of metal and having holes engaged with the pins of the outer circular body, a vibration switch fitted in the vibration switch hole and electrically connected with the IC, and a plurality of light-emitting means fitted in the apertures and electrically connected with the IC and the batteries, whereby the circuit board is prevented from being broken even subjected to vigorous vibration and two bright tracks will be produced when the roller is rotated.

7 Claims, 7 Drawing Sheets

ILLUMINATING ROLLER FOR IN-LINE SKATES

BACKGROUND OF THE INVENTION

1. Field of the Invention

This invention is related to a roller for in-line skates and in particular to one which will give light in rotation.

2. Description of the Prior Art

As shown in FIGS. 9 and 10, the conventional illuminating roller for in-line skates includes an annular ring-shaped circuit board 5 on which are mounted a flashing IC (integrated circuit) 51, a plurality of battery seats 53 for receiving batteries 52, a vibration switch 54 and a plurality of light-emitting diodes 55. As the roller is rotated, the vibration switch 54 will be turned on thereby triggering the IC 51 to drive the light-emitting diodes 55 to flash.

As the component parts are all mounted on the circuit board 5, the circuit board 5 must be shaped as an annular ring order to receive all of the component parts. However, such a circuit board is easily broken when subjected to vigorous vibration thereby short-circuiting the circuit board 5 and making the roller unable to give light.

In addition, the two light-emitting diodes are arranged on the same circle with respect to the axis of the roller, so that there will be only one bright track when the roller is rotated thus making it look dull and monotonuous.

Therefore, it is an object of the present invention to provide an improved illuminating roller for in-line skates which can obviate and mitigate the above-mentioned drawbacks.

SUMMARY OF THE INVENTION

This invention is related to an improved illuminating roller for in-line skates.

According to a preferred embodiment of the present invention, an illuminating roller for in-line skates includes an outer circular body having an axial opening and an inner side provided with a plurality of pins, an inner circular body fitted inside the outer circular body and having an axial hole aligned with the axial opening, the inner circular body including a first half and a second half engageable with the first half, the second half being formed with a cavity, two battery recesses, and a vibration switch hole, a circuit board fitted in a cavity of the second half, the circuit board being provided with an IC, two battery mountings made of metal and fitted in the two battery recesses, batteries fitted on the battery mountings for supplying power to the IC, a battery cover made of metal and having holes engaged with the pins of the outer circular body, a vibration switch fitted in the vibration switch hole and electrically connected with the IC, and a plurality of light-emitting means fitted in the apertures and electrically connected with the IC and the batteries.

It is the primary object of the present invention to provide an illuminating roller for in-line skates which is sturdy in construction.

It is another object of the present invention to provide an illuminating roller for in-line skates which will produce two bright tracks when the roller is rotated.

It is still another object of the present invention to provide an illuminating roller for in-line skates which has a long service life.

It is still another object of the present invention to provide an illuminating roller for in-line skates which can prevent the circuit board therein from being broken even when subjected to vigorous vibration.

It is a further object of the present invention to provide an illuminating roller for in-line skates which is easy to manufacture.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
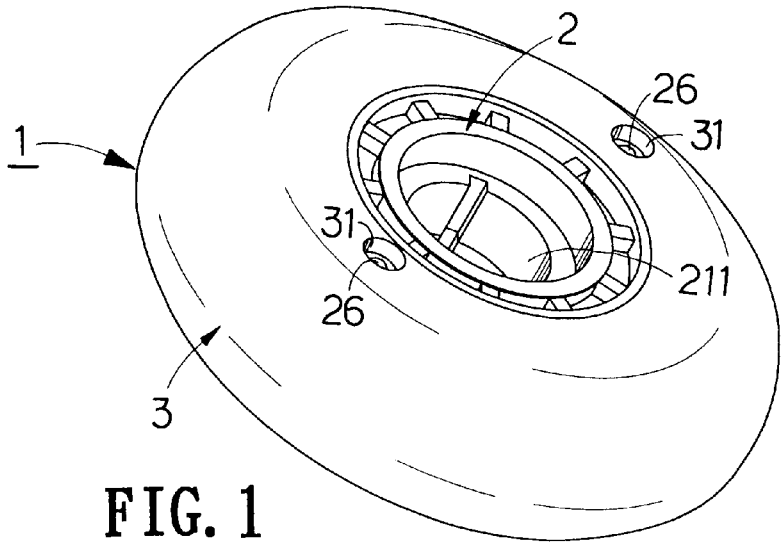
FIG. 1 is a perspective view of the present invention.
Figure 2:
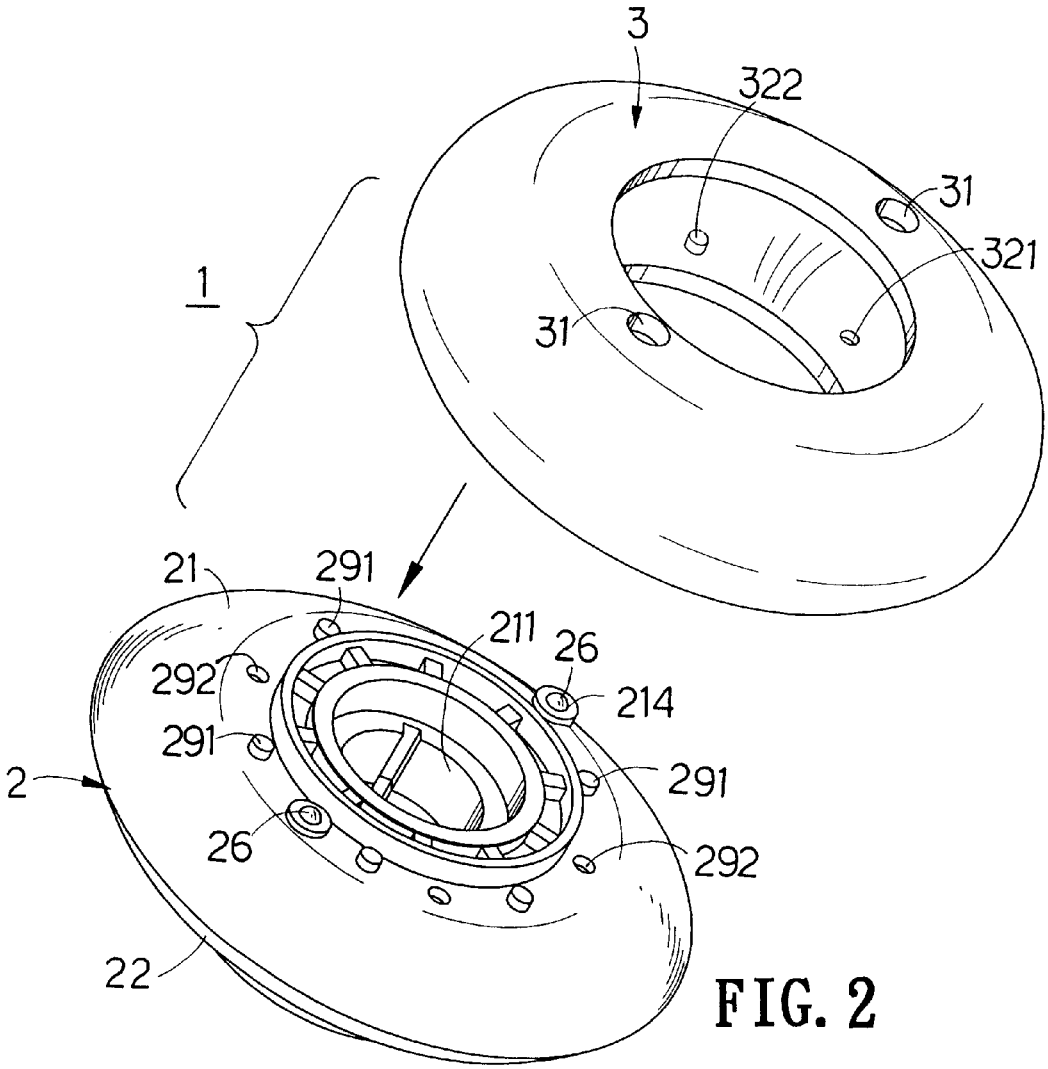
FIG. 2 illustrates the relationship between the outer and inner circular bodies.
Figure 3:
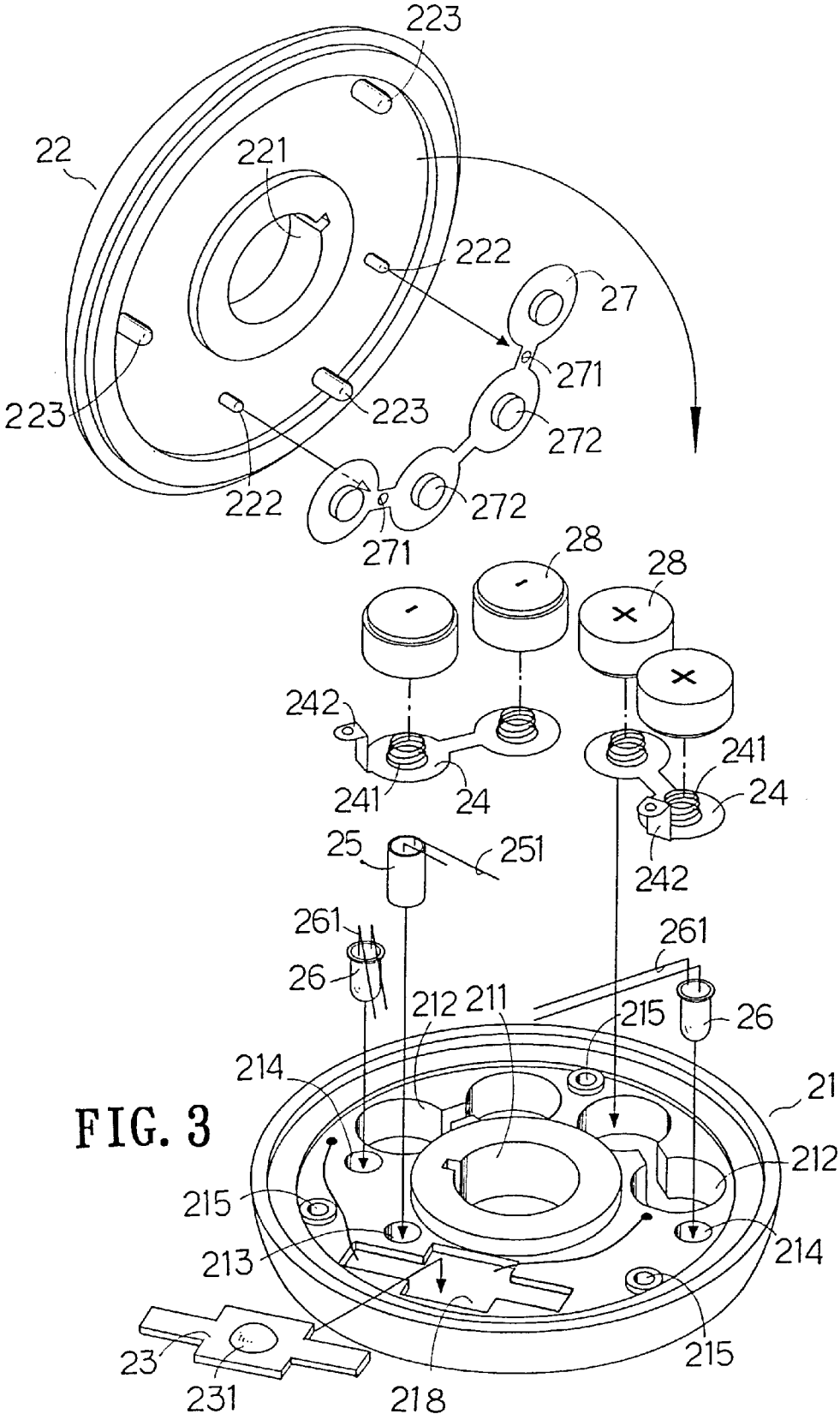
FIG. 3 is an exploded view of the present invention.
Figure 4:
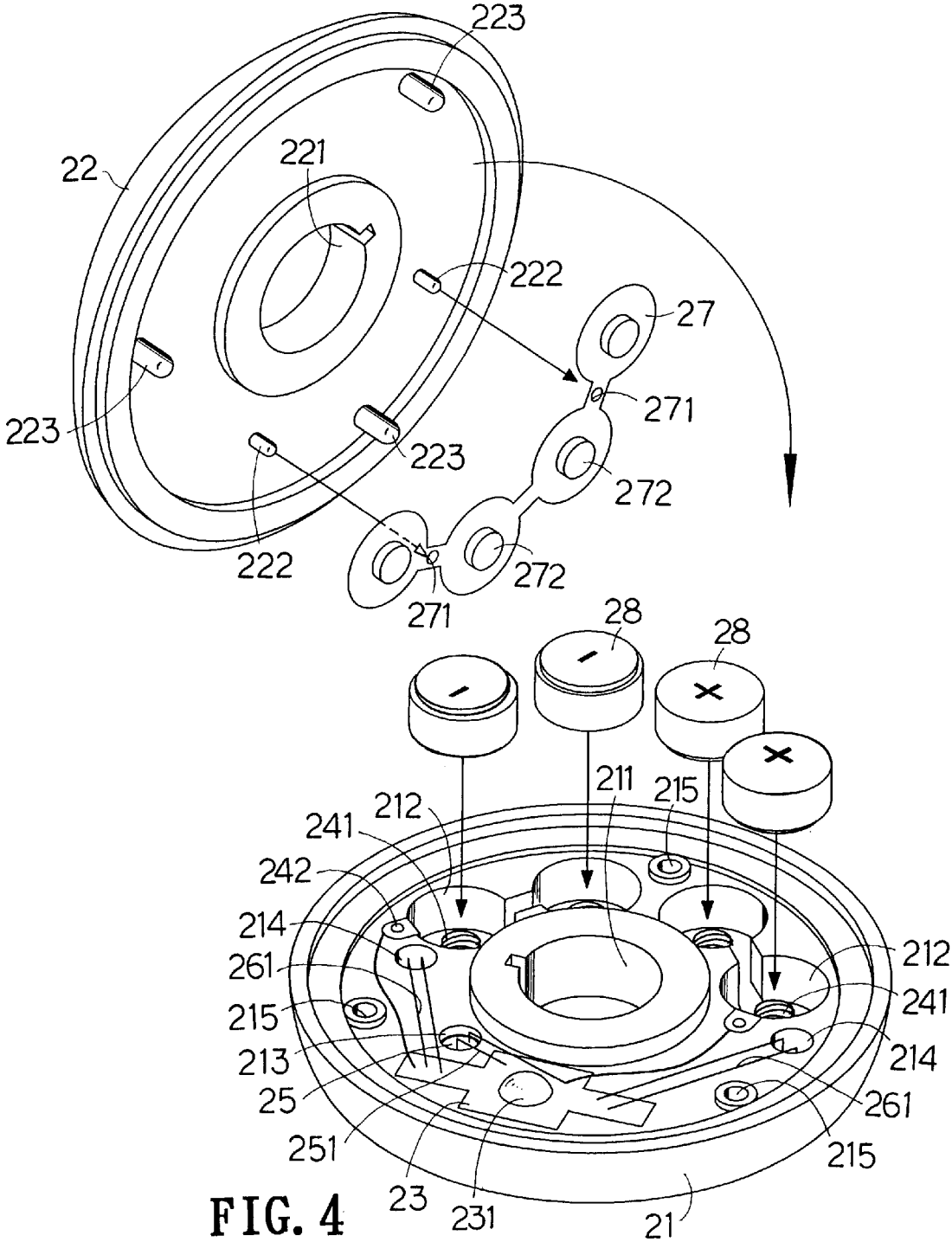
FIG. 4 is another exploded view of the present invention.
Figure 5:
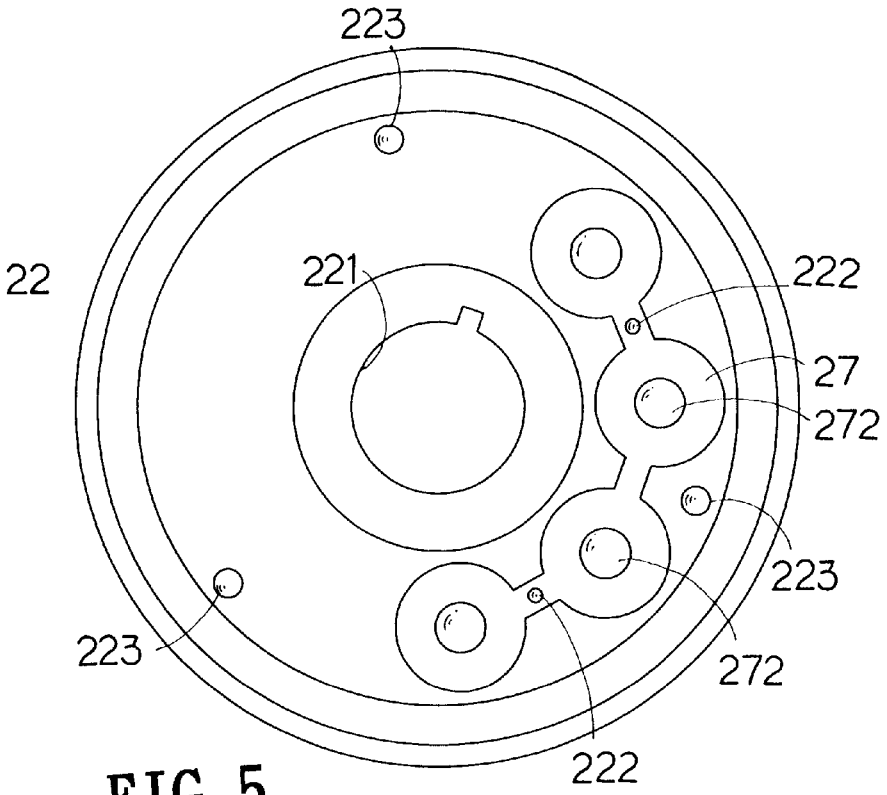
FIG. 5 is a top view of the first half of the inner circular body.
Figure 6:
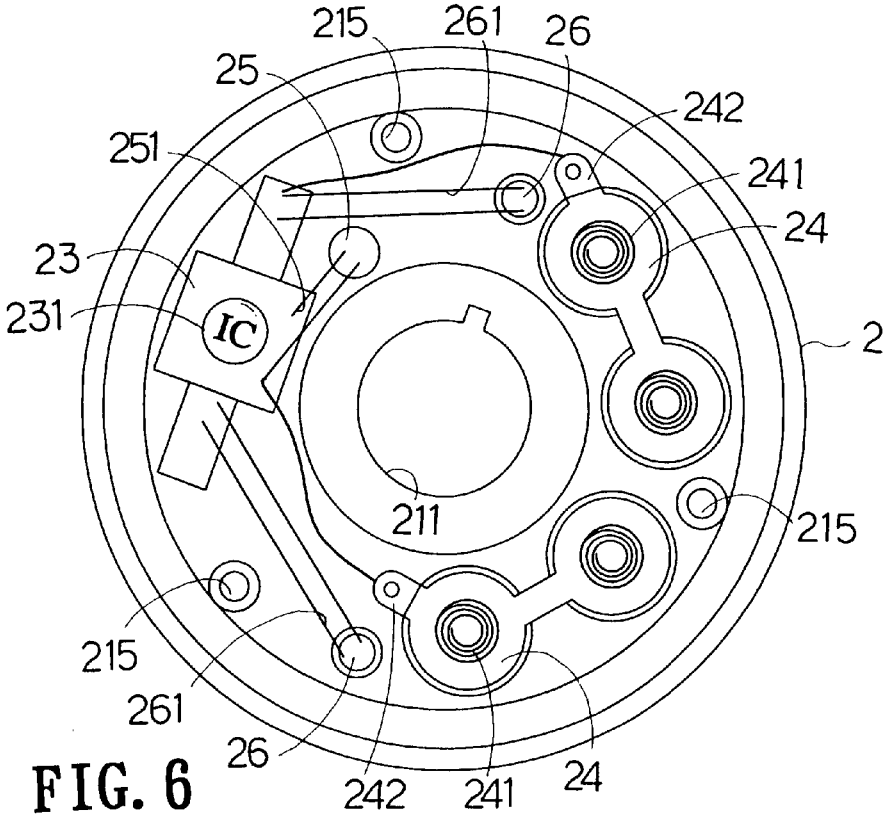
FIG. 6 is a top view of the second half of the inner circular body.

With reference to the drawings and in particular to FIGS. 1 and 2 thereof, the roller 1 for in-line skates according to the present invention generally comprises an inner circular body 2 and an outer circular body 3 enclosing the inner circular body 2. The inner circular body 2 is composed of a first and second halves 21 and 22.

Figure 8:
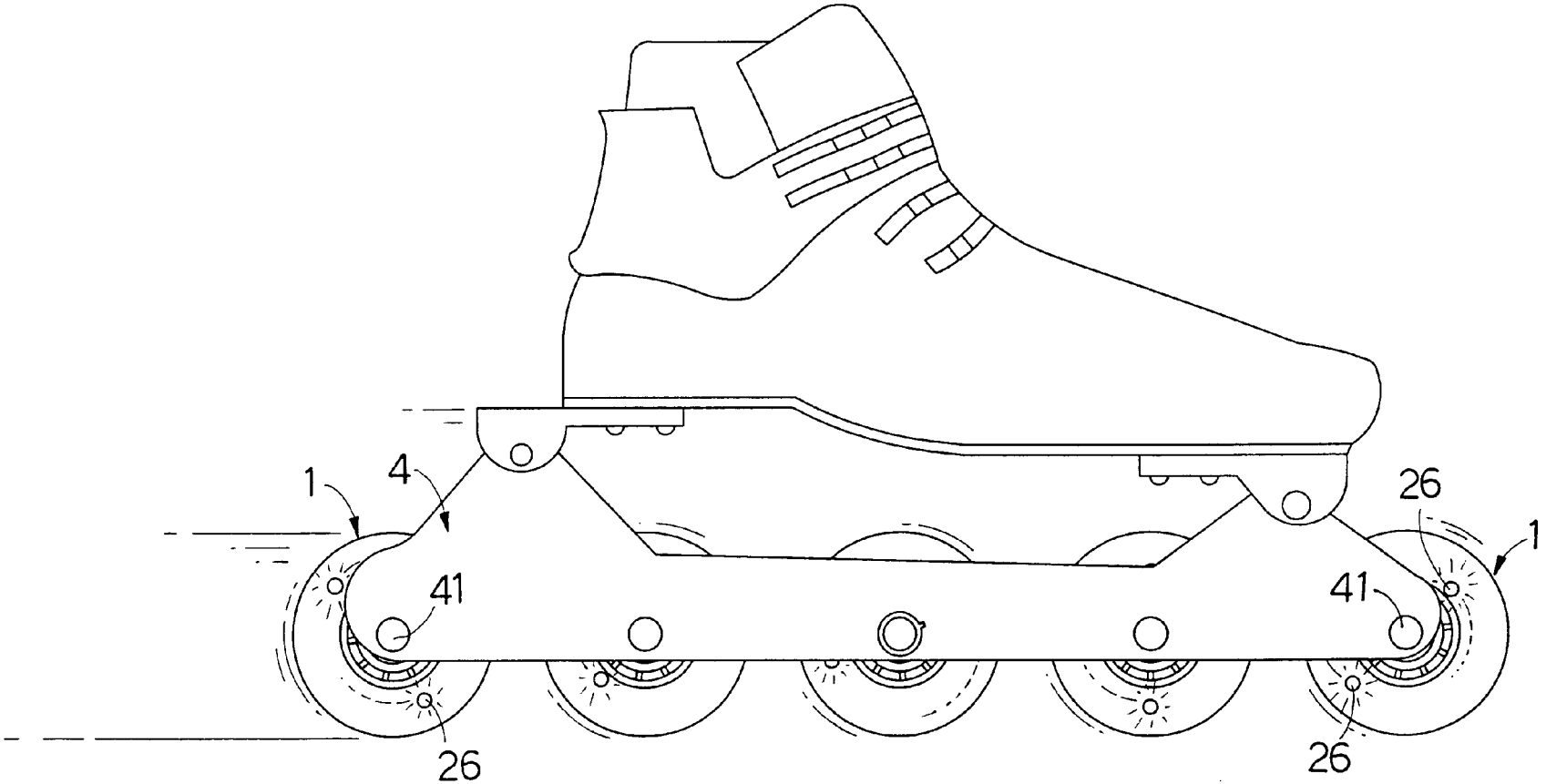
FIG. 8 is a working view of the present invention.
Figure 9:
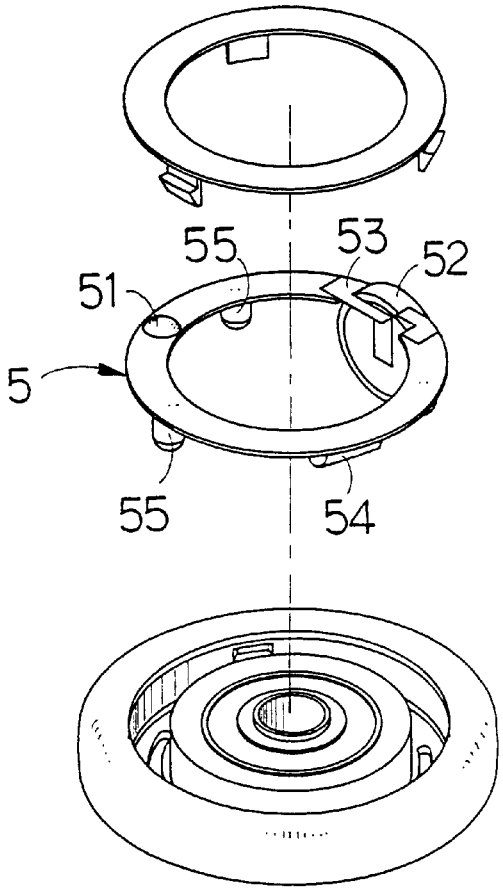
FIG. 9 (PRIOR ART)
FIG. 9 is an exploded view of a first prior art illuminating roller.
Figure 10:
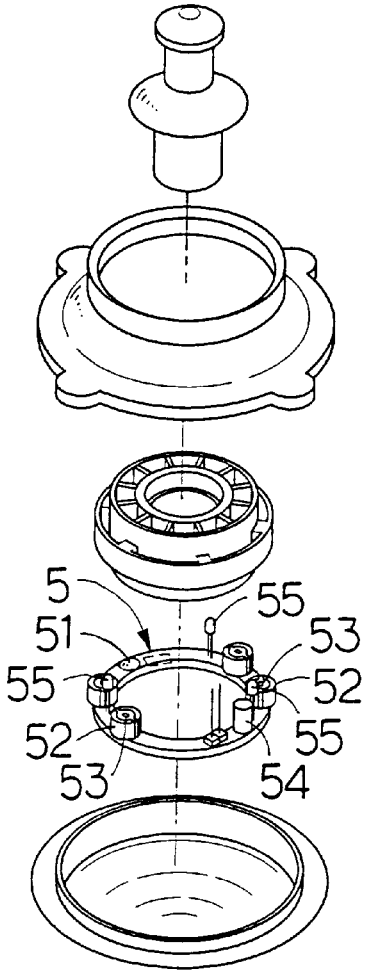
FIG. 10 (PRIOR ART)
FIG. 10 is an exploded view of a second prior art illuminating roller.

Referring to FIGS. 3, 4, 5 and 6, the first half 21 is formed at the center with a through hole 211 and at the inner side with a cavity 218, two battery recesses 212, a hole 213, two holes 214, and three holes 215. The through hole 211 is used for pivotally receiving an axle 41 of a frame 4 (see FIG. 8). The cavity 218 is used for receiving a circuit board 23 on which is mounted an IC (integrated circuit) 231. The recesses 212 are used for receiving two battery mountings 24 on each of which are arranged two batteries 28. The hole 213 is used for receiving a vibration switch 25, while the holes 214 for receiving light-emitting means 26 such as light-emitting diodes.

The second half 22 has a through hole 221 at the center, a plurality of first pins 222 and a plurality of second pins 223 at the inner side thereof. The first pins 222 are used for inserting through respective holes 271 of a battery cover 27 thereby keeping the battery cover 27 in position. The second pins 223 are engageable with the holes 215 of the first half 21. When the first and second halves 21 and 22 are joined together, the hole 211 of the former will be aligned with the hole 221 of the latter.

Each of the battery mountings 24 is composed of two circular metal sheets joined together with a metal strip. On each of the circular metal sheets is mounted a spring 241 for contacting the positive or negative electrode of the battery 28. One circular metal sheet of the battery mounting 24 is provided with an inverted L-shaped lug 242.

The battery cover 27 is composed of four circular metal sheets (see FIG. 5) on each of which there is a protuberance 272 adatped for contacting the positive or negative electrode of the battery 28.

The first half 21 is formed with a cavity 218 and holes 213 and 214 so tht the component parts on the circuit board 23 will be firmly kept within the inner circular body 2 and will not get out of their positions even subjected to strong vibration. As the circuit board 23 is small in size, it will not break even when subjected to strong vibration. The batteries 28 are fitted between the battery cover 27 and the battery mountings 24 thereby keeping the batteries 28 firmly in place.

Figure 7:
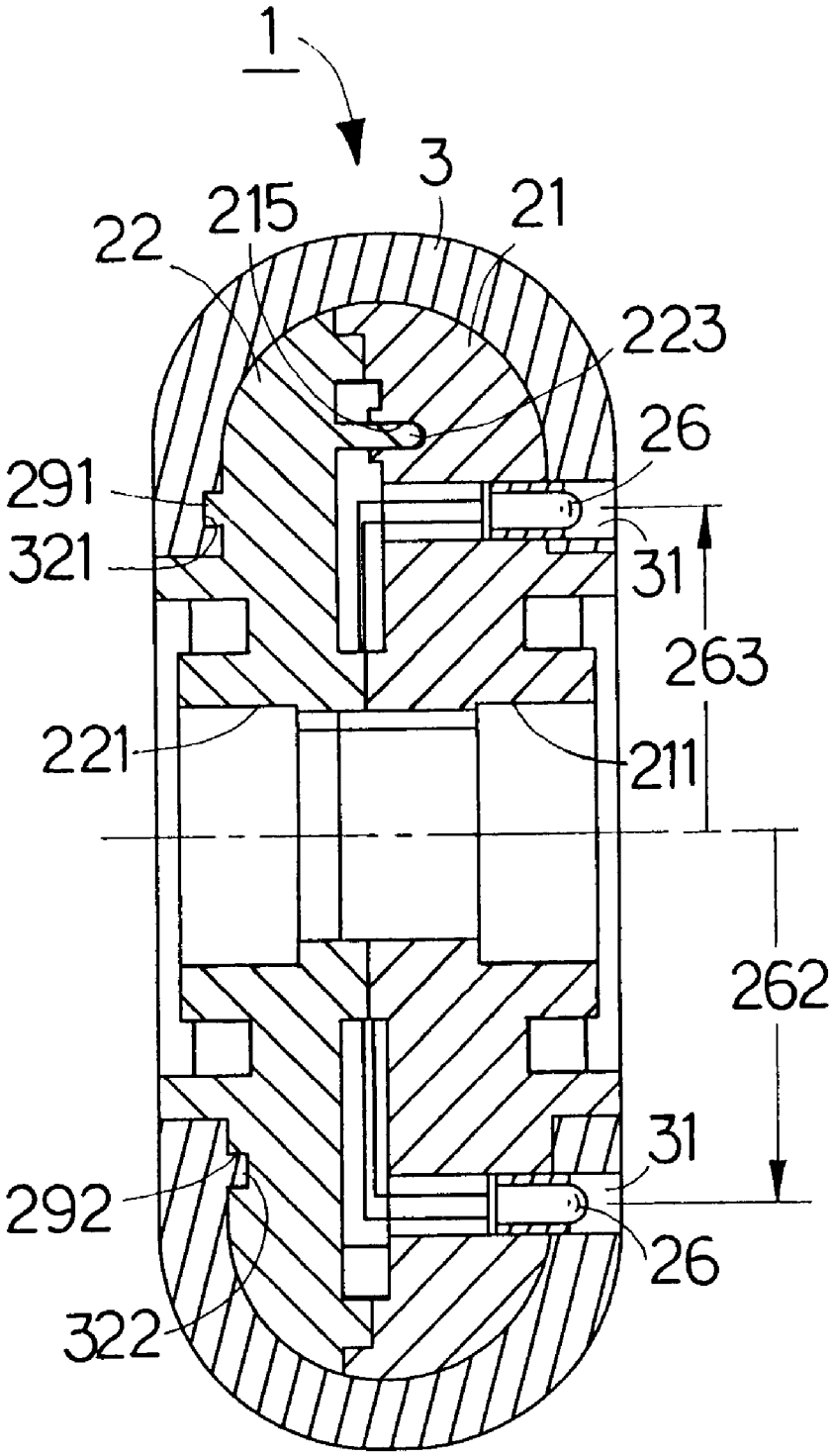
FIG. 7 is a sectioanl view of the present invention.

The light-emitting means 26 are mounted on the second half 21 at different positions (see FIG. 7), e.g. one light-emitting means 26 is arranged at a position having a distance 262 from the axis of the second half 21 while the other light-emitting means 26 having a distance 263 from the axis of the second half 21. The distance 262 is larger than the distance 263 thereby producing two concentric circular bright tracks when the roller 1 is rotated. The two legs 261 of the light-emitting means 26 are bent through an angle of 90 degrees (see FIG. 4) to be soldered on the circuit board 23. Similarly, the two legs of the vibration switch 25 are also bent through an angle of 90 degrees to be soldered on the circuit board 23. The outer circular body 3 may be made of transparent or translucent material. If the outer circular body 3 is made of transparent material, the outer circular body 3 will provide an effect of refraction. It the outer circular body is made of translucent material, rays of light will be given out through the holes 31 of the outer circular body 3. Furthermore, in order to enable the inner circular body 2 to be closely fitted inside the outer circular body 3, the inner circular body 2 is provided with a plurality of projections 291 and holes 292 adapted to engage with respective holes 321 and projections 322 of the outer circular body 3.

As the roller 1 rotates, the vibration switch 25 will be subjected to vibration thereby triggering the IC 231 on the circuit board 23 to cause the light-emitting means 26 to flash. As the light-emitting means 26 are located at different distances from the axis of the second half 21, there will be two concentric bright tracks when the roller 1 rotates.

Accordingly, the present invention has the following advantanges:

1. The circuit board and the component parts inside the roller will not be damaged even if the in-line skate is subjected to strong vibration or heavily thrown down on the ground.

2. The light-emitting means are mounted at different distances from the axis of the roller, so that when the roller is rotated, there will be two bright tracks (see FIG. 8).

3. If the outer circular body 3 is made of transparent material, the outer circular body 3 will provide an effect of refraction. It the outer circular body is made of translucent material, rays of light will be given out of the outer circular body when the roller is rotated.

4. The illuminating roller can make the in-line skate look more interesting and is durable in use.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. An illuminating roller for in-line skates comprising:

an outer circular body having an axial opening and an inner side provided with a plurality of pins;

an inner circular body fitted inside said outer circular body and having an axial hole aligned with said axial opening, said inner circular body including a first half and a second half engageable with said first half, said second half being formed with a cavity, two battery recesses, and a vibration switch hole;

a circuit board fitted in a cavity of said second half, said circuit board being provided with an IC;

two battery mountings made of metal and fitted in said two battery recesses;

batteries fitted on said battery mountings for supplying power to said IC;

a battery cover made of metal and having holes engaged with said pins of said second half of said inner circular body;

a vibration switch fitted in said vibration switch hole and electrically connected with said IC; and a plurality of light-emitting means fitted in said apertures and electrically connected with said IC and said batteries.

2. The illuminating roller for in-line skates as claimed in claim 1, wherein said light-emitting means are arranged in said second half at different distances from an axis of said second half thereby producing two light tracks when said roller is rotated.

3. The illuminating roller for in-line skates as claimed in claim 1, wherein said battery mounting includes two circular metal sheets joined together and two springs each installed on each of said circular metal sheets to contact an electrode of said battery, said battery mounting being provided with an inverted L-shaped lug at an edge thereof.

4. The illuminating roller for in-line skates as claimed in claim 1, wherein said battery cover includes four circular metal sheets joined together and each having. a projection to contact an electrode of said battery.

5. The illuminating roller for in-line skates as claimed in claim 1, wherein said second half has an inner side provided with a plurality of pins configured to go through respective holes of said battery cover thus keeping said battery cover in place.

6. The illuminating roller for in-line skates as claimed in claim 1, wherein said inner circular body is provided with a plurality of projections configured to engage with respective holes of said outer circular body.

7. The illuminating roller for in-line skates as claimed in claim 1, wherein said inner circular body is provided with a plurality of holes configured to engage with respective projections of said outer circular body.

* * * * *